US005214812A

United States Patent [19]

Bartow et al.

[11] Patent Number: 5,214,812

[45] Date of Patent: Jun. 1, 1993

[54] BREAKAWAY FOOT SECTION FOR DELIVERY BED

[75] Inventors: Richard J. Bartow, Athens Township, Calhoun County; Louis A. Haddock, Jr., Emmett Township, Calhoun County; John S. Messner, Battle Creek, all of Mich.; Terry R. Lingmann, Oregon City, Oreg.

[73] Assignee: Stryker Corporation, Kalamazoo, Mich.

[21] Appl. No.: 837,537

[22] Filed: Feb. 14, 1992

Related U.S. Application Data

[63] Continuation-in-part of Ser. No. 738,511, Jul. 31, 1991, abandoned.

[51] Int. Cl.[5] ..... A47C 20/04; A61G 7/06

[52] U.S. Cl. ..... 5/624; 5/602; 5/648; 5/618

[58] Field of Search ..... 5/602, 618, 619, 624, 5/648, 651, 660, 661

[56] References Cited

U.S. PATENT DOCUMENTS

| | | | |
|---|---|---|---|
| 1,038,623 | 9/1912 | Merchant | 5/60 |
| 2,067,891 | 1/1937 | Comper | 269/328 |
| 2,832,655 | 4/1958 | Adolphson | 5/602 |
| 3,220,022 | 11/1965 | Nelson | 5/80 |
| 3,318,596 | 5/1967 | Herzog | 269/328 X |
| 3,606,302 | 9/1971 | Allard et al. | 5/443 X |
| 4,168,554 | 9/1979 | Hindes | 5/466 X |
| 4,225,127 | 9/1980 | Strutton | 269/328 X |
| 4,426,071 | 1/1984 | Klevstad | 269/328 X |
| 4,639,954 | 2/1987 | Speed | 5/63 |
| 4,821,350 | 4/1989 | Feldt | 5/60 |
| 4,894,876 | 1/1990 | Fenwick | 5/60 |
| 4,968,013 | 11/1990 | Kuck | 5/624 X |
| 5,157,800 | 10/1992 | Borders | 5/602 |

FOREIGN PATENT DOCUMENTS 2911743 10/1979 Fed. Rep. of Germany ..... 269/328

OTHER PUBLICATIONS

Drawing Figure labelled "Sketch A", submitted by applicant on Feb. 14, 1992.

*Primary Examiner*—Michael F. Trettel

*Attorney, Agent, or Firm*—Flynn, Thiel, Boutell & Tanis

[57] ABSTRACT

A delivery bed includes two spaced foot support assemblies which project outwardly from one end thereof. Each foot support assembly includes a first horizontally extending member having a top surface with transversely extending grooves and having a bottom surface, and a second member having two spaced, transversely extending rods which respectively slidably engage the top surface and bottom surface of the first member, the second member having therein a foot-shaped recess. A pad can be removably supported on the two foot support assemblies without any need for additional support structure for the pad intermediate the foot support assemblies. The pad is held in place by two fastening straps which extend downwardly between the foot support assemblies and are each releasably coupled to a respective one of the foot support assemblies. Alternatively, the pad can be held in place by brackets on the pad which releasably engage brackets provided on the foot support assemblies near the outer ends thereof.

34 Claims, 4 Drawing Sheets

BREAKAWAY FOOT SECTION FOR DELIVERY BED

This application is a continuation-in-part of U.S. Ser. No. 07/738,511, filed Jul. 31, 1991 now abandoned.

FIELD OF THE INVENTION

This invention relates generally to a delivery bed, and more particularly, to a foot rest structure for the bed which is easy to disassemble and clean, and a removable support pad which can be supported on the foot rests without additional supporting structure.

BACKGROUND OF THE INVENTION

Conventional delivery beds typically have a pair of spaced foot rests at one end thereof, which preferably are positionally adjustable to facilitate use of the bed with patients of different sizes. However, the adjustment mechanisms in these foot rests are typically rather complex, and may for example include a gear mechanism. The complex nature of the adjustment mechanism frequently provides a variety of locations which can harbor dust, dirt, blood or the like, and thus these mechanisms are relatively difficult and time consuming to thoroughly clean, which is a problem in view of the fact that delivery beds are typically used in environments where cleanliness is essential. Moreover, the complex nature of the adjustment mechanisms frequently makes it timeconsuming or even impractical to disassemble the foot rests for purposes of cleaning, which can in and of itself restrict access to the adjustment mechanism so as to make the cleaning process even more time consuming and difficult.

These conventional beds also typically have a removable pad which extends between and is supported in part by the foot rests. However, some additional support structure is invariably provided between the foot rests to support the center portion of the pad, usually in the form of a support member which extends between and is temporarily coupled to the foot rests, or a support member which is temporarily coupled to and projects outwardly from the bed itself. The need for the additional support part is a disadvantage of these conventional arrangements, not only because of the time required to attach and detach the support part, but also because of the fact that when the support part is detached it is necessary to find a place to store it, and if it does not happen to be stored on the bed itself, it may become misplaced and thus prevent safe use of the removable pad.

It is therefore an object of the present invention to provide a delivery bed having foot rests with adjustment mechanisms which are simple in structure and easy to disassemble, in order to facilitate rapid disassembly and cleaning of the foot rests, and in order to reduce the cost of the foot rest.

A further object is to provide a removable pad for a delivery bed which can be supported entirely by the foot rests with no intervening support structure for the pad between the foot rests.

It is a further object of the invention to provide a removable support pad which can be releasably fastened to foot rests of a delivery bed in a manner which does not interfere with the tucking-in of sheets placed on the delivery bed.

SUMMARY OF THE INVENTION

The objects and purposes of the invention, including those set forth above, are met according to one form of the present invention by the provision of an apparatus which includes a patient support part having an upwardly facing patient support surface, and a foot support assembly supported on the patient support part. The foot support assembly includes a first member supported on the patient support part and extending in an approximately horizontal direction, the first member having spaced first and second surface portions on an upper side thereof and spaced third and fourth surface portions on an underside thereof. The foot support assembly further includes a second member and a support arrangement supporting the second member on the first member for movement between first and second positions, the support arrangement including spaced first and second portions on the second member which are respectively disposed above and below the first member, the first and second portions of the second member respectively engaging the first and third surface portions when the second member is in its first position and respectively engaging the second and fourth surface portions when the second member is in its second position. The support arrangement includes an arrangement which releasably holds the second member against movement parallel to the horizontal direction with respect to the first member.

A different form of the present invention involves the provision of a patient support part having an upwardly facing patient support surface and having spaced foot support assemblies projecting approximately horizontally outwardly therefrom, and a pad removably resting on and extending between the foot support assemblies, a portion of a top surface on the pad which is adjacent the support surface being at substantially the same vertical level as the support surface, the apparatus being free of structure supporting the pad between the foot support assemblies.

Yet another form of the present invention involves the provision of an apparatus which includes a patient support part having an upwardly facing patient support surface, and a foot support assembly supported on the patient support part. The foot support assembly includes a first member supported on the patient support part and extending in an approximately horizontal direction, the first member having spaced first and second surface portions on an upper side thereof and spaced third and fourth surface portions on an underside thereof. The foot support assembly includes a second member and a support arrangement supporting the second member on the first member for movement between first and second positions, the support arrangement including spaced first and second portions on the second member which are respectively disposed above and below the first member, the first and second portions of the second member respectively engaging the first and third surface portions when the second member is in its first position and respectively engaging the second and fourth surface portions when the second member is in its second position. A manually operable retaining arrangement has first and second operational positions and is cooperable with the second member for respectively preventing and permitting movement of the second member past its second position in a direction away from its first position.

BRIEF DESCRIPTION OF THE DRAWINGS

Preferred embodiments of the present invention are described in detail hereinafter with reference to the accompanying drawings, in which.

DETAILED DESCRIPTION

Figure 1:
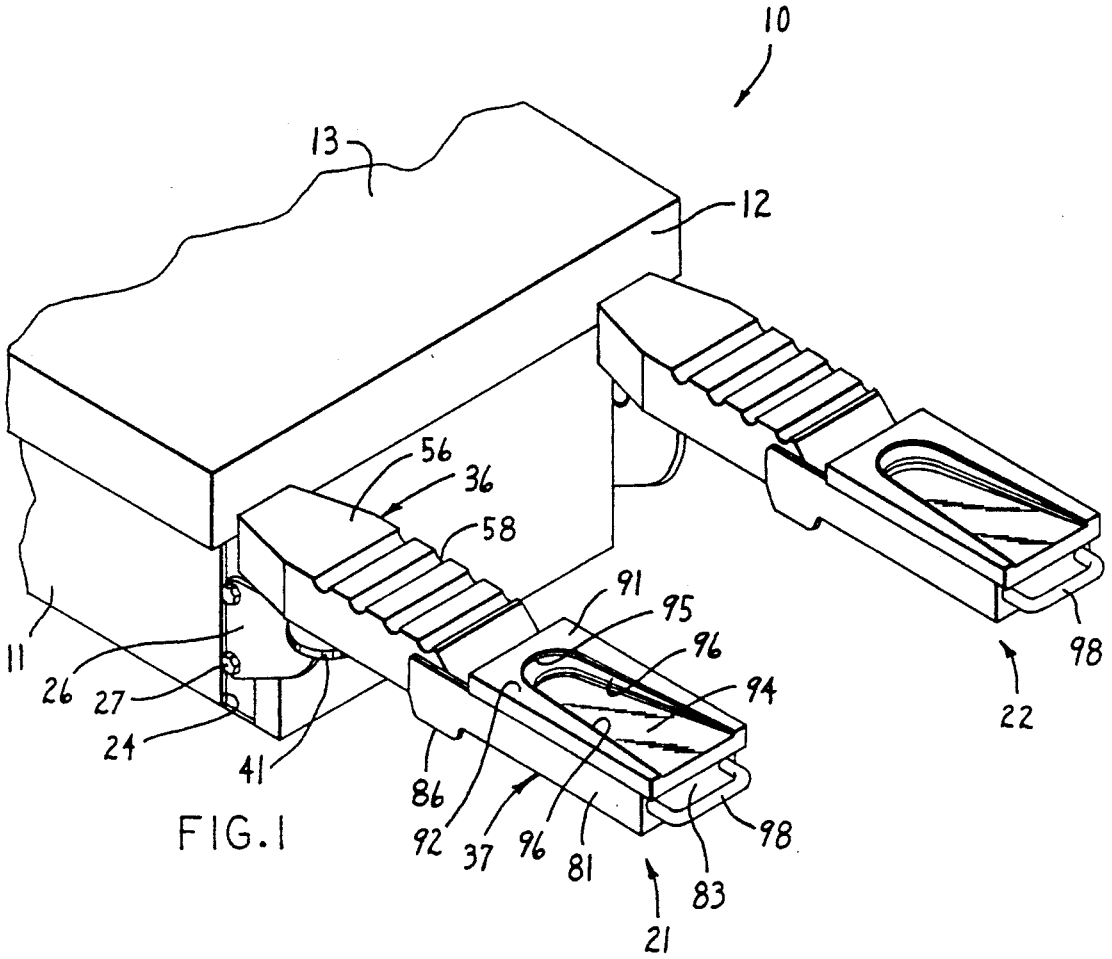
FIG. 1 is a fragmentary perspective view of a delivery bed which embodies the present invention.

FIG. 1 shows a portion of a delivery bed 10 which embodies the present invention. The bed 10 includes a body or frame 11, and a mattress or cushion 12 provided on top of the frame 11. The cushion 12 has an upwardly facing support surface 13 on which a patient can lie or sit.

The bed 10 has two spaced foot support assemblies 21 and 22 which extend outwardly from one end of the frame 11. The frame 11 includes a conventional mechanism which can effect vertical movement of the foot support assemblies 21 and 22. In particular, referring to FIGS. 1 and 3, the frame 11 of the bed 10 has in each of its opposite sides near one end thereof a respective vertically extending slot 24, and has just inside the slot 24 an elongate nut 25 which is itself conventional and can be moved vertically in a conventional manner. For example, the nut might be provided on a not-illustrated vertically extending threaded shaft, rotation of the shaft by a conventional motor or manually operated drive mechanism effecting reciprocal vertical movement of the nut.

Figure 3:
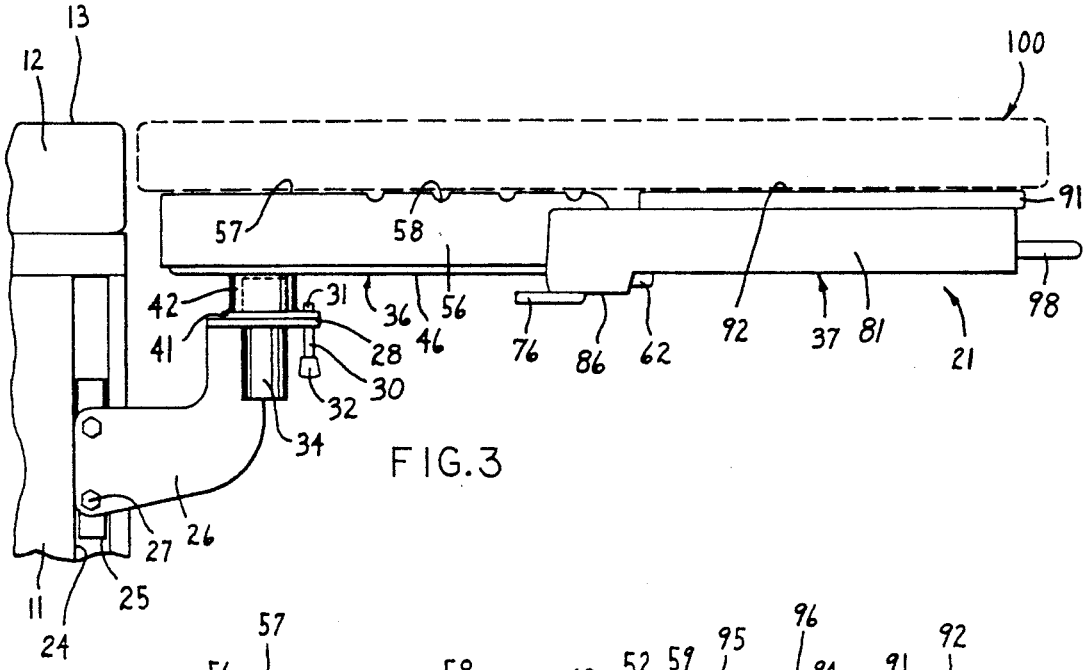
FIG. 3 is an elevational side view of a foot support assembly which is a component of the bed of FIG. 1.

The foot support assemblies 21 and 22 are basically identical, and therefore only the foot support assembly 21 will be described in detail. As shown in FIGS. 1 and 3, the foot support mechanism 21 includes an approximately L-shaped metal plate 26 which is secured by two screws 27 to the member 25 for vertical movement therewith. A horizontal plate 28 of approximately circular shape is welded to the other end of the bracket 26. A cylindrical sleeve 30 has a threaded upper end which engages a threaded hole provided in the plate 28. A cylindrical pin 31 is slidably disposed in the sleeve 30 and is urged upwardly relative to sleeve 30 by a not illustrated spring, the pin 31 having secured to its lower end a knob 32 which can engage the lower end of sleeve 30 in order to limit upward movement of pin 31. When the knob 32 is engaging the lower end of sleeve 30, the upper end of pin 3 projects upwardly above the top of plate 28. The pin 31 can be manually pulled downwardly by knob 32 against the force of the spring until the upper end of pin 31 is below the top of plate 28. A vertically extending cylindrical rod 34 extends through a central circular opening of approximately equal diameter provided in the plate 28, and is welded to the plate 28. As shown in FIG. 3, the upper end of rod 34 projects upwardly above the top surface of plate 28.

Figure 4:
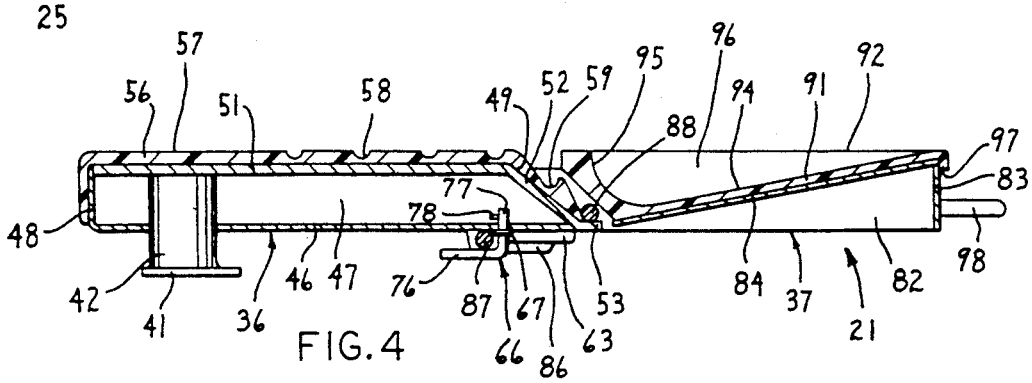
FIG. 4 is a sectional side view of the foot support assembly of FIG. 3.

The foot support assembly 21 includes a support member 36 and a foot rest member 37 which are movable relative to each other in a manner described in more detail later. Referring to FIGS. 3 and 4, the support member 36 includes an approximately circular plate 41 which is welded to the lower end of a sleeve 42 and which has an opening concentric to the sleeve 42 into which the upper end of the rod 34 on plate 28 can extend. The underside of plate 41 is slidably disposed against the upper side of plate 28, and thus the support member 36 and foot rest member 37 can together pivot relative to the bracket 26 about the central axis of rod 34. The plate 41 has several angularly spaced vertical holes through it, each of which can receive the upper end of the pin 31 in order to releasably lock the support member 36 and foot rest member 37 in a selected angular position relative to the bracket 26.

Referring to FIG. 4, the support member 36 has a horizontal bottom wall 46, two spaced side walls 47 extending upwardly from opposite edges of the bottom wall 46, and an end wall 48 extending between the side walls, the side walls 47 each having at an end remote from the end wall 48 an inclined edge 49. The bottom wall 46, side walls 47 and end wall 48 are all integral portions of a single bent metal plate. The support member 36 also includes a top wall 51 which extends between and is welded to upper edges of the side walls 47 and end wall 48, an inclined wall 52 which extends along and is welded to the inclined edges 49 at the ends of the side walls 47, and a support tab 53 which projects horizontally outwardly from the end of support member 36 substantially coplanar with the bottom wall 46. The top wall 51, inclined wall 52 and support tab 53 are all integral portions of a single bent metal plate. The sleeve 42 extends through an opening in and is welded to the bottom wall 46, and has its upper end disposed against and welded to the underside of top wall 51.

The support member 36 also includes a molded urethane cover 56 which extends over the top wall 51, inclined wall 52, side walls 47 and end wall 48. The cover 56 is preferably glued to the support member 36 with any conventional and commercially available adhesive commonly used with urethane. An upwardly facing surface 57 of the cover 56 has four transversely extending grooves or recesses 58 above the top wall 51 at spaced locations between the sleeve 42 and inclined wall 52, and has a further transverse groove or recess 59 approximately halfway down the inclined wall 52.

Figure 2:
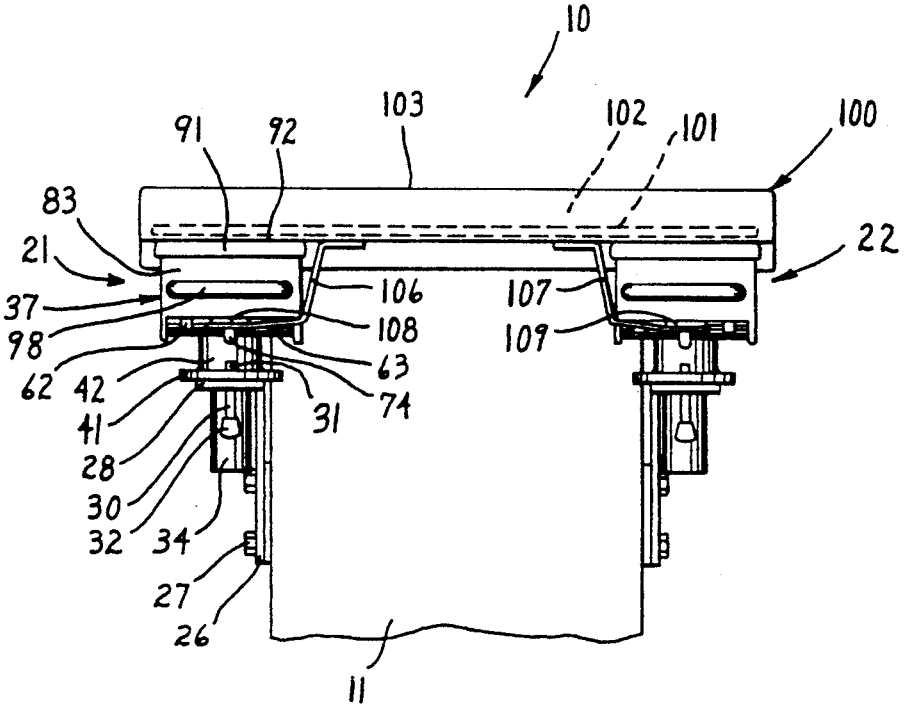
FIG. 2 is a fragmentary end view of the bed of FIG. 1.
Figure 6:
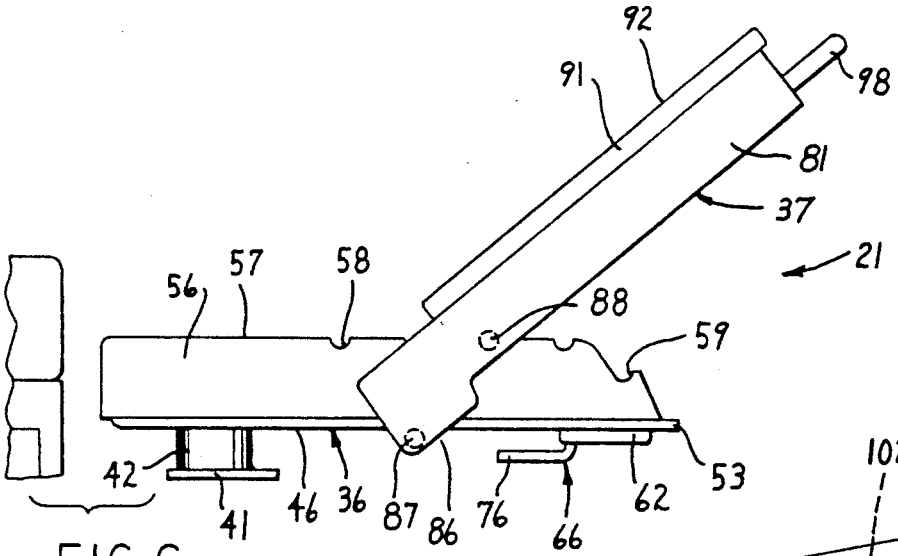
FIGS. 6 and 7 are elevational side views of the foot support assembly which are similar to FIG. 3 but show the foot support assembly in different operational positions.

Referring to FIG. 2, two stop elements 62 and 63 are welded to and project downwardly from the bottom wall 46 of support member 36. As best seen in FIG. 6, they are elongated in the lengthwise direction of the support member 36, and they extend parallel to each other.

Figure 5:
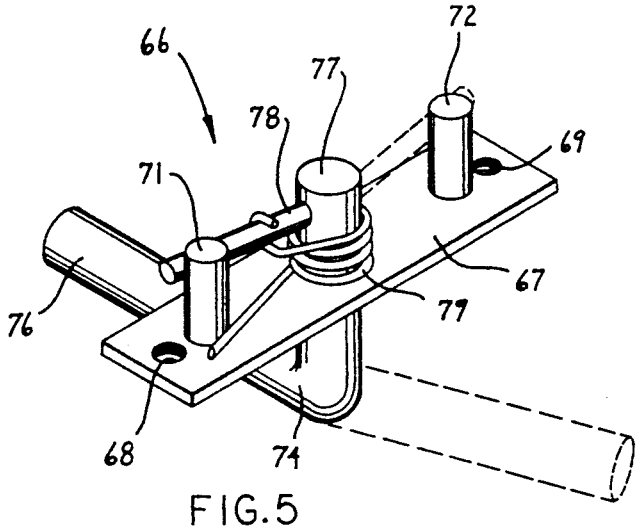
FIG. 5 is a perspective view of a retaining mechanism which is part of the foot support assembly of FIG. 3.

Intermediate the stop elements 62 and 63 is a retaining mechanism 66 (FIGS. 4 and 5). The retaining mechanism 66 includes a rectangular plate 67 which is disposed against an underside of the bottom wall 46 and covers a rectangular opening provided in the bottom wall 46. The plate 67 has holes 68 and 69 at its respective ends, and the plate 67 is secured to the bottom wall 46 by not-illustrated screws which extend through the holes 68 and 69 and threadedly engage not-illustrated holes in the bottom wall 46. Two cylindrical stops 71 and 72 are fixedly secured to the plate 67 and each project upwardly near a respective one of the holes 68 and 69. An L-shaped retaining member 74 has two legs 76 and 77 which extend at a right angle with respect to each other, the leg 76 being pivotally supported in an opening provided in the plate 67 intermediate the stops 71 and 72. An arm 78 has one end fixedly secured in a radial opening near the upper end of leg 77, and extends radially outwardly. A spring 79 encircles the leg 77 and has two legs respectively engaging the radial arm 78 and the stop 71, so that the retaining member 74 is urged to pivot about leg 77 until radial arm 78 engages stop 71. The retaining member 74 can be manually pivoted so that leg 76 moves approximately 180° until the radial arm 78 engages the stop 72, which corresponds to movement of leg 76 from the position shown in solid lines to the position shown in broken lines.

Turning now to the foot rest member 37, there are two spaced, parallel metal plates which serve as side walls 81 and 82 and which have ends disposed on opposite sides of the support member 36 adjacent thereto. An end wall 83 extends between and is welded to ends of the side walls 81 and 82 remote from the support member 36, and an inclined wall 84 extends between and is welded to the side walls 81 and 82, one end of the inclined wall 84 being adjacent and welded to the upper end of the end wall 83. Each of the side walls 81 and 82 has at its left end in FIGS. 3 and 4 an integral, downwardly projecting tab 86. As shown in FIG. 4, a cylindrical connecting rod 87 extends between and has its end welded to the respective tabs 86 of side walls 81 and 82, and a further cylindrical connecting rod 88 which is spaced from and parallel to the rod 87 extends between and has its ends welded to the side walls 81 and 82, the rod 88 being located near an end of the inclined wall 84 remote from the end wall 83. The rod 87 slidably engages the undersurface of bottom wall 46 of support member 36, while the rod 88 slidably engages the upper surface 57 of the cover 56, can be selectively placed in one of the grooves 58 or the groove 59, as discussed in more detail later or can engage the support tab 53.

The foot rest member 37 also includes a molded urethane foot rest 91, which engages the inwardly facing surfaces of side walls 81 and 82 and inclined wall 84. As shown in FIGS. 1 and 4, the urethane foot rest 91 has in an upper surface 92 thereof an approximately foot-shaped recess which has a flat bottom surface 94 extending approximately parallel to the inclined wall 84, a curved end surface 95 near an end remote from the end wall 83, and two side surfaces 96 which diverge from the curved end surface 95 to the end at the end wall 83. The depth of the foot-shaped recess progressively decreases from the curved end surface 95 to the end adjacent end wall 83. The urethane foot rest has along three sides of its upper edge a lip shown at 97 in FIG. 4, the lip 97 gripping over the upper edges of side walls 81 and 82 and end wall 83.

A U-shaped handle 98 is secured to and projects outwardly from the end wall 83.

As shown in FIGS. 2 and 3, a removable rectangular pad 100 extends between and has its opposite edge portions supported on the upper surfaces of the foot support assemblies 21 and 22. As shown in FIG. 3, when the removable pad 100 is on the foot support assemblies 21 and 22, the foot support assemblies 21 and 22 are preferably set at a vertical height so that the upper surface of pad 100 is at substantially the same level as the upper surface 13 of cushion 12, thus providing a larger overall support surface for a patient. As shown in FIG. 2, the pad 100 has a rigid sheet 101 of a material such as plywood embedded in a foam core 102, the core 102 having a greater thickness above the plywood 101 than below it. In the preferred embodiment, a thin sheet of foam and a thicker sheet of foam are respectively placed below and above the plywood 101 during manufacture, the edges of each foam sheet projecting outwardly beyond the peripheral edges of the plywood 101. Then, the edge portions of the foam sheets which project beyond the plywood are glued to each other using a conventional adhesive. A vinyl cover 103 is then provided over the entire pad 100.

It should be noted that there is no structure supporting the center portion of the pad 100, either in the form of a member which extends between and is supported on the foot support assemblies 21 and 22, or a member which is directly supported on the frame 11 of bed 10. Referring to FIG. 2, the cover 103 of pad 100 includes two straps 106 and 107 which each have an end secured to the underside of pad 100 and which each extend downwardly between the foot support assemblies adjacent a respective one of the foot support assemblies. The other end of each of the straps 106 and 107 is secured to a respective one of the foot support assemblies 21 and 22 by a respective fastening arrangement 108 or 109, the fastening arrangements 108 and 109 preferably being a hook and loop fastening mechanism such as that commonly sold under the trademark VELCRO. The straps 106 and 107 preferably extend downwardly in the region between the foot support assemblies 21 and 22 rather than on the outer sides of the foot support assemblies 21 and 22, so that bedding or the like can be easily tucked between the pad 100 and the upper surfaces of foot support assemblies 21 and 22 without interference from the straps 106 and 107.

Figure 7:
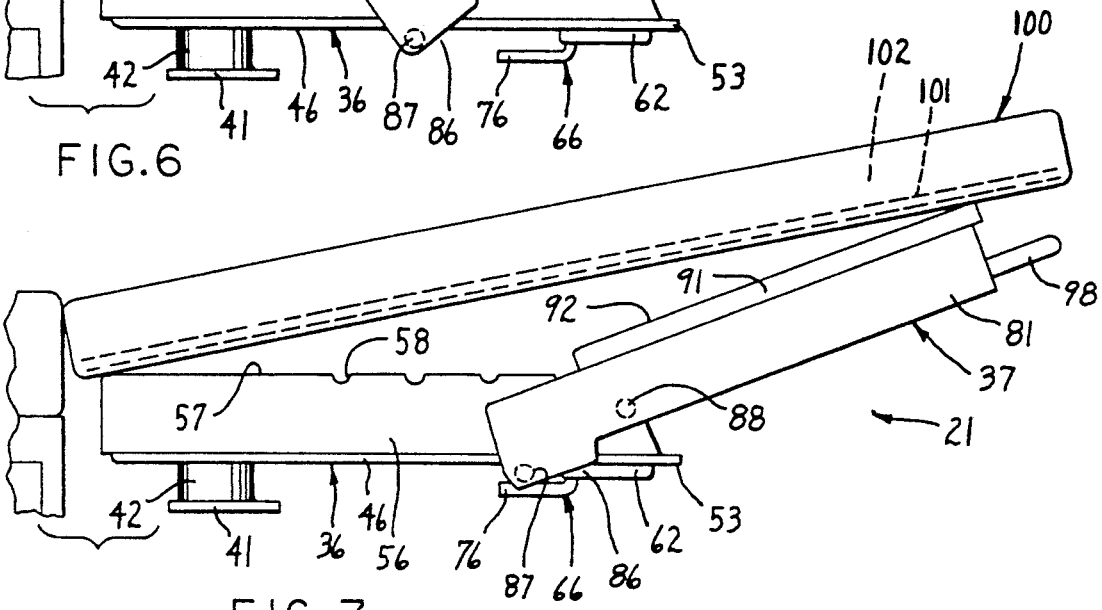
Figure 8:
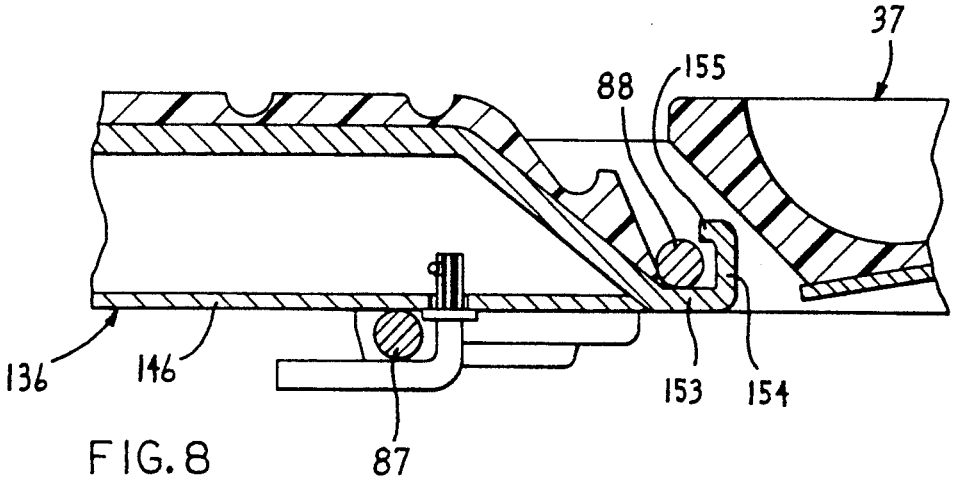
FIG. 8 is a fragmentary sectional view of an alternative embodiment of the foot support assembly of FIG. 3.

FIG. 8 shows an alternative embodiment which, except for the differences described below, is identical in all respects to the embodiment described above in association with FIGS. 1-7. In FIG. 8, the support member 136 has at its outer end a tab which is bent to be approximately hook-shaped, the tab including a portion 153 which extends outwardly approximately coplanar with the bottom wall 146 of support member 136, an upright portion 154 which extends upwardly from the outer end of the portion 153, and a flange 155 which extends back toward the member 136 from the upper end of the upright portion 154.

Figure 9:
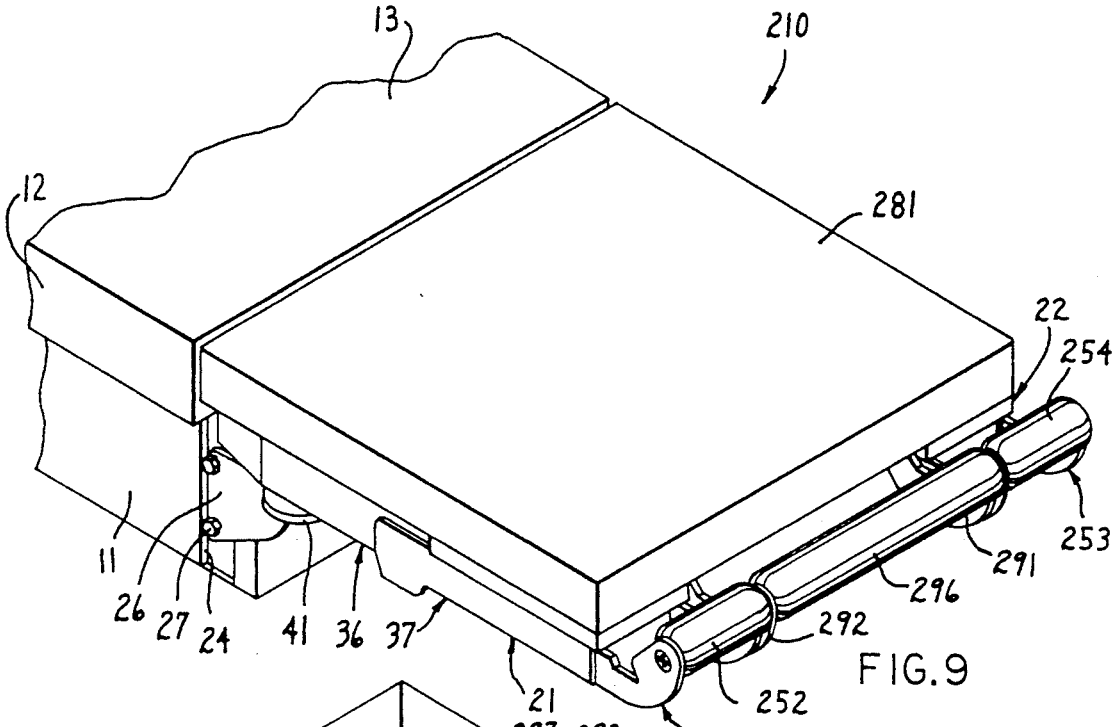
FIG. 9 is a fragmentary perspective view of a delivery bed which embodies the present invention and which is an alternative embodiment of the bed of FIG. 1.
Figure 10:
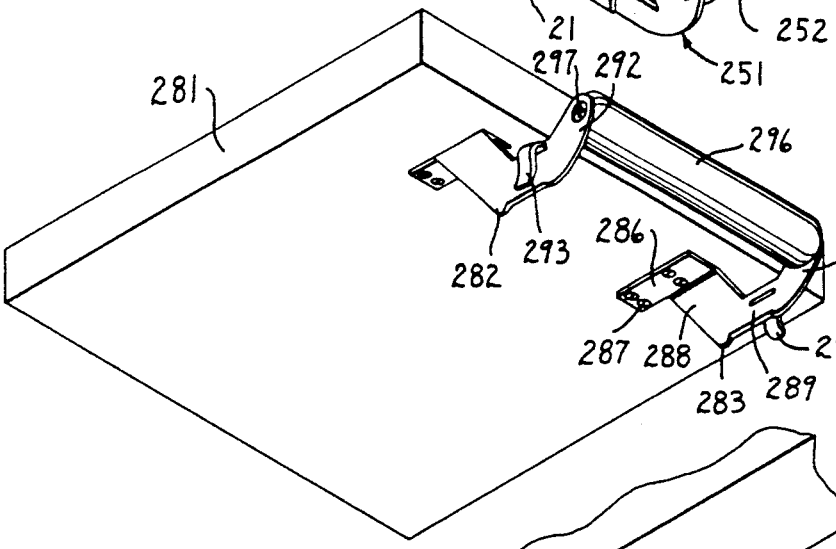
FIG. 10 is a perspective view of the underside of a pad which is a component of the bed of FIG. 9.
Figure 11:
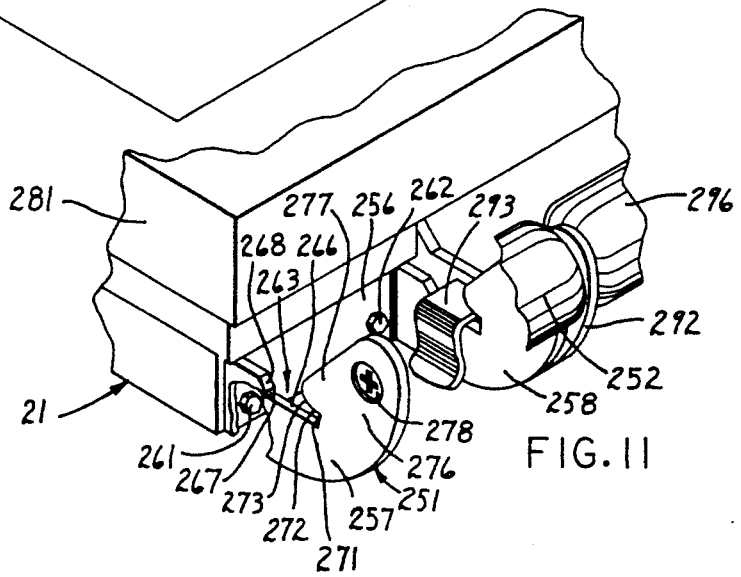
FIG. 11 is a portion of the perspective view of FIG. 9, shown in an enlarged scale and with some structure cut away for clarity.

FIGS. 9-11 show yet another alternative embodiment of the delivery bed, which in FIG. 9 is designated with reference numeral 210. Except for the differences described below, the bed 210 is identical to the bed 10 of FIG. 1, and identical parts have therefrom been identified with the same reference numerals.

Although the foot support assemblies 21 and 22 of FIG. 9 are identical to those in FIG. 1, the handles 98 shown at the outer ends thereof in FIG. 1 have been replaced with different handles in the embodiment of FIG. 9. In particular, the foot support assembly 21 has mounted at the outer end thereof a metal bracket 251 which supports a cylindrical plastic handle part 252, and the foot support assembly 22 has at the outer end thereof an identical bracket 253 and handle part 254. Since the parts 251 and 252 are respectively identical to the parts 253 and 254, only the parts 251 and 252 are described in detail.

As shown in FIG. 11, the bracket 251 is U-shaped and made from a bent piece of metal, and has a bight 256 and two parallel legs 257 and 258 extending outwardly from opposite ends of the bight. The bight 256 is disposed against the outer end of the foot support assembly 21, and is fixedly secured to the foot support assembly by two screws 261 and 262. The legs 257 and 258 are of identical shape, and therefore only the leg 257 is described in detail.

In particular, the outwardly projecting leg 257 has in an upper side thereof a shallow recess 263 with an upwardly facing horizontal bottom surface 266, a vertical end surface 267 at the end nearest the foot support assembly 21, and an inclined surface 268 which extends upwardly and toward the foot support assembly from the upper end of the end surface 267. At the opposite end of the recess is a vertical end surface 271, a downwardly facing horizontal retaining surface 272 which extends a short distance over the recess from the upper end of the end surface 271, and an inclined surface 273 which extends upwardly from the outer end of the retaining surface 272 approximately parallel to the inclined surface 268.

The leg 257 of the bracket has at its outer end an upwardly extending portion 276 having thereon a projection 277 which extends toward the foot support assembly 21 and which has thereon the retaining surface 272 and inclined surface 273. The handle part 252 extends between the outer, upper ends of the legs 257 and 258. The handle part 252 is secured to the leg 257 by a screw 278 which extends through an opening in the upwardly projecting portion 276 of the leg, and is secured at its opposite end to the leg 258 in a similar manner.

The foot support assemblies 21 and 22 in FIG. 9 support a pad 281 which has plywood and foam provided therein in a manner similar to that shown at 101 and 102 in FIG. 2 for pad 100. The pad 281 does not, however, have straps which are similar to the straps shown at 106 and 107 in FIG. 2. Instead, as shown in FIG. 10, two spaced metal brackets 282 and 283 are secured to the underside of the pad. The brackets 282 and 283 are mirror images of each other. The bracket 283 has a base plate 287 which is disposed against the underside of the pad and is fixedly secured to the pad by four screws 287 which cooperate with the plywood disposed within the pad. The bracket has a portion 288 extending downwardly and outwardly from the base plate 286, a center portion 289 extending horizontally outwardly from the outer end of the portion 288, and an outer portion 291 extending outwardly and upwardly from the outer end of the center portion 289, the outer portion of the other bracket 282 being designated with reference numeral 292.

The bracket 282 has an approximately S-shaped clip 293 with one end welded to the upper part of the horizontally extending center portion of the bracket 282, the clip extending outwardly from the center portion of the bracket, then downwardly and inwardly to a location adjacent a lower part of the center portion of the bracket, and then downwardly and outwardly again. The clip 293 is made from a bent metal strip which has a width less than the horizontal distance between inclined surfaces 268 and 273 (FIG. 11). The bracket 283 has an equivalent clip which is shown at 294 in FIG. 10.

It will be recognized that the metal clips 293 and 294 could be replaced with plastic clips which are of similar shape and which are secured to the brackets 282 and 283 by screws.

A cylindrical plastic handle part 296 has a diameter substantially equal to the diameters of handle parts 252 and 254, extends between the outer, upper ends of the outer portions 291 and 292 of the brackets 282 and 283, and is fixedly secured to the brackets by screws which extend through the brackets and into the handle parts, one of which is shown at 297 in FIG. 10.

When the pad 281 is supported on the foot support assemblies 21 and 22, the clips 293 and 294 each receive an adjacent leg of a respective one of the brackets 251 and 253, as shown in FIG. 11 for leg 258 of bracket 251, and the upper portion of each clip is disposed in the recess in that leg. For example, FIG. 11 shows the upper portion of clip 293 disposed in the recess in leg 258. In this configuration, the handle parts 252, 254 and 296 are substantially coaxially aligned, and the ends of handle part 296 are each adjacent the ends of a respective one of the handle parts 252 and 254.

OPERATION

If the rectangular pad 100 is initially present, as shown in FIG. 2, a patient can sit or lie on top of the pad 100 and/or the cushion 12. When at some point the foot support assemblies 21 and 22 are needed, the VELCRO fastening arrangements 108 and 109 are disengaged by manually pulling the ends of straps 106 and 107 away from the foot support assemblies 21 and 22, and then the pad 100 can be lifted off the foot support assemblies 21 and 22 and stored in some nearby convenient location. Referring to FIG. 4, the rod 87 of foot rest member 37 is slidably disposed against the underside of bottom wall 46 of support member 36, and engages one end of the stop elements 62 and 63. The leg 76 of retaining element 74 prevents the rod 87 from moving downwardly to a position below the stop elements 62 and 63 and thereafter moving rightwardly past the stop elements. Meanwhile, the rod 88 is disposed against the upwardly facing surface of the tab 53. Thus, the support member 36 and the foot rest member 37 project outwardly in substantially the same horizontal direction, so that the upwardly facing surfaces 57 and 92 thereon are approximately coplanar.

The handle 98 can then be used to lift the outer end of foot rest member 37 so that it pivots counterclockwise in FIG. 4 about rod 87 relative to support member 36, and then the foot rest member 37 can be slid leftwardly relative to the support member 36, with the rods 87 and 88 respectively below and above the support member 36. Then, the rod 88 can be placed in one of the grooves 58, as shown for example in FIG. 6. The groove 58 in which the rod 88 is placed is typically selected in dependence on the length of the legs of the patient. A patient on the bed can then place a foot in the foot rest member 37, and even if the patient pushes against the foot rest member 37 it will not move outwardly, because of the engagement between rod 88 and the selected groove 58. Further, by pulling downwardly on the knob 32 of pin 31 (FIG. 3), the upper end of pin 31 can be disengaged from a hole in plate 41 and the entire foot rest 21 or 22 can be pivoted about the central vertical axis of rod 34 to a desired position, after which the knob 32 can be released so that the upper end of pin 31 engages a different hole in the plate 41 in order to releasably lock the foot support assembly 21 or 22 in its new pivotal position.

In order to return the foot rest member 37 to its original position, the handle 98 is lifted slightly so that the rod 88 disengages from the selected groove 58, and then the foot rest member 37 is slid rightwardly in FIG. 4 relative to the support member 36 until the rod 87 engages the ends of stop elements 62 and 63, and then the handle 98 is used to pivot foot rest member 37 downwardly until rod 88 is again engaging the upper surface of tab 53, as shown in FIG. 4. Then, if desired, the pad 100 can be placed back on the foot support assemblies 21 and 22, in order to return the delivery bed 10 to its original configuration.

Instead of placing the cylindrical rod 88 in one of the grooves 58, the rod can also be placed in groove 59. This places the foot rest member 37 in the position shown in FIG. 7, and as evident from a comparison of FIGS. 6 and 7, the angle at which the foot rest member 37 extends upwardly relative to the support member 36 will be less than is the case when rod 88 is engaging one of the grooves 58. In the position of FIG. 7, the pad 100 is placed back on top of the foot support assemblies 21 and 22 so that it extends at an incline and lifts the feet of the patient. The straps 106 and 107 are typically not reattached in this particular position. The purpose of the configuration shown in FIG. 7 is to elevate the feet of the patient above the head of the patient, which is commonly referred to as the trendelenburg position. If a medical emergency should arise during use of the bed 10, the bed can be rapidly adjusted to the configuration of FIG. 7 in order to elevate the feet of the patient and achieve a trendelenburg position. If the pad is already in place when the foot rests are in the position shown in FIG. 3, the straps 106 and 107 can be released and then the handles 98 can be raised without removing the pad in order to achieve the position of FIG. 7.

It will be noted that the structure which movably supports the foot rest member 37 on the support member 36 is relatively simple, and in particular does not include a complex mechanical arrangement such as a gear mechanism which could harbor dust, dirt, blood or the like and would thus be tedious and time-consuming to clean. Instead, the rods 87 and 88 which cooperate with the upper and lower surfaces of the support member 36 constitute a very simple structure which can be rapidly and thoroughly cleaned with minimal effort. In order to facilitate cleaning, the foot support assemblies 21 and 22 are designed to be quickly and easily disassembled and reassembled.

In particular, with the foot rest member 37 and support member 36 in the positions shown in FIG. 4, the leg 76 of retaining member 74 is pivoted 180° until it is pointing rightwardly rather than leftwardly in FIG. 4, and then the foot rest member 37 is manually tilted about rod 88 so that rod 87 moves downwardly to a position below the retaining member 74, and then the foot rest member 37 is moved rightwardly relative to the support member 36 until it is separated from the support member 36. The support member 36 is then lifted upwardly so that the sleeve 42 slides upwardly off the upper end of the rod 34 on the bracket 26. After cleaning, the components of the foot support assembly can be quickly reassembled by simply performing the steps just mentioned in a reverse order.

Referring to FIG. 1, the handles 98 on the foot support assemblies 21 and 22 can be used to maneuver the delivery bed 10 if the bed is provided with wheels or casters. In order to facilitate this maneuvering, it is desirable in some situations to provide a way of preventing the foot rest member 37 of each foot support assembly 21 and 22 from pivoting upwardly relative to the associated support member 36. The alternative embodiment of FIG. 8 provides an effective and inexpensive solution to this need. In particular, when an operator is pulling on the handle 98, the cylindrical rod 88 will be disposed below the flange 155, and thus the flange 155 will prevent the cylindrical rod 88 from moving upwardly, so that the foot rest member 37 is essentially locked against upward pivotal movement. In order to pivot the foot rest member 37 upwardly to an inclined position suitable for use as a footrest, for example the position of FIG. 6, the foot rest member 37 is moved leftwardly a small distance in FIG. 8 so that the cylindrical rod 88 moves away from the upright wall portion 154, at which point the foot rest member 37 can be pivoted counterclockwise about rod 87 and cylindrical rod 88 can move upwardly past the flange 155.

Turning to the embodiment of FIGS. 9–11, when the pad 281 is installed on the foot support assemblies 21 and 22 in the manner shown in FIG. 9, the clips 293 and 294 each engage an adjacent leg of a respective one of the brackets 251 and 253, as shown in FIG. 11 and as previously described. Thus, and taking into account the plywood in the pad 281, the pad 281 and the brackets on it relatively rigidly mechanically couple the left and right foot support assemblies 21 and 22, so that the foot end of the bed is a more rigid unit in and of itself and with respect to the rest of the bed. Consequently, if lateral forces are manually applied to any of the handle parts 252, 254 and 296 in order to pivot the bed, the bed will pivot smoothly and with negligible play between the foot support assemblies and the rest of the bed. Further, the pad 281 is held against significant horizontal movement in any direction with respect to the foot support assemblies 21 and 22. In addition, the coaxially aligned handle parts 252, 254 and 296 together form a large, convenient and attractive handle at the foot end of the bed. The bed can be maneuvered more easily than with the small handles shown at 98 in FIG. 1.

When the center handle part 296 is used to move the bed, an orderly may push away and down on the handle part 296, as a result of which the clips 293 and 294 will each be urged downwardly and forwardly, or in other words downwardly against surface 266 and forwardly against surface 267. On the other hand, when the handle part 296 is used to pull the bed, the clips 293 and 294 will slide forwardly a small amount within the recesses in the brackets 251 and 253, so that an edge of each clip underlies the associated retaining surface 272. Thus, even if a pulling and lifting force is exerted on the handle, the clips 293 and 294 and thus the handle part 296 will be held against upward movement away from the foot support assemblies.

In order to remove the pad 281, the handle part 296 on the pad is pushed and lifted, so that the clips 293 and 294 move to engage the end surface 267 of the associated recess and are thus out from under the downwardly facing retaining system 272, and then due to the lifting force move out of the recesses along an inclined path between the inclined surfaces 268 and 273. As soon as the clips 293 and 294 are out of the recesses, the entire pad 281 can be lifted off the foot support assemblies 21 and 22. The pad 281 is reinstalled by performing in reverse order the sequence of steps described above to remove it.

While the pad 281 is separated from the bed, the handle part 296 serves as a convenient handle for moving or carrying the pad, whereas without such a handle, the mattress is difficult to grasp and cumbersome to move, maneuver or transport. Further, it will be noted that removing the pad involves the removal of only the pad; there is no other part which must be removed with the pad and which could be lost or immediately misplaced.

Although two preferred embodiments of the invention have been disclosed in detail for illustrative purposes, it will be recognized that variations or modifications of the disclosed embodiments, including the rearrangement of parts, lie within the scope of the present invention.

The embodiments of the invention in which an exclusive property or privilege is claimed are defined as follows:

1. An apparatus comprising: a patient support part having an upwardly facing patient support surface, and a foot support assembly supported on said patient support part, said foot support assembly including a first member supported on said patient support part and extending in an approximately horizontal direction, said first member having spaced first and second surface portions on an upper side thereof and spaced third and fourth surface portions on an underside thereof, said foot support assembly further including a second member and support means supporting said second member on said first member for movement between first and second positions, said support means including spaced first and second portions on said second member which are respectively disposed above and below said first member, said first and second portions of said second member respectively engaging said first and third surface portions when said second member is in said first position and respectively engaging said second and fourth surface portions when said second member is in said second position, and said support means including means for releasably holding said second member against movement parallel to said horizontal direction with respect to said first member.

2. An apparatus according to claim 1, wherein said second member has herein a recess for a foot.

3. An apparatus according to claim 1, wherein support means includes said first member having two spaced recesses therein, one of said first and second portions of said second member engaging a respective one of said recesses in each of said first and second positions of said second member.

4. An apparatus according to claim 3, wherein said second member has spaced side wall portions disposed on opposite sides of said first member and has spaced connecting portions extending between said side wall portions, said connecting portions each including a respective one of said first and second portions.

5. An apparatus according to claim 4, wherein said connecting members are respectively first and second cylindrical rods respectively including said first and second portions, said recesses in said first member being transversely extending grooves in an upper surface thereof.

6. An apparatus according to claim 5, including a stop projecting downwardly from said underside of said first member and engageable with said second rod to limit movement of said rod along said underside of said first member, and a retaining member supported on said first member near said stop for pivotal movement about a vertical axis between first and second positions in which said retaining member respectively permits and prevents downward movement of said second rod when said second rod is adjacent said stop.

7. An apparatus according to claim 5, including a further wall extending between and secured to said side wall portions, and a molded urethane part supported on said side wall portions and said further wall, said urethane part having therein a foot-shaped recess.

8. An apparatus according to claim 7, including a handle secured to an end of said second member remote from said first member, and wherein said first member has in the region of said second surface portion a hook-shaped member which can limit upward movement of said first rod when said first rod is engaging said second surface portion and said handle is being manually pulled in a direction away from said first member.

9. An apparatus according to claim 1, wherein said second member extends upwardly at an angle with respect to said first member in each of said first and second positions thereof.

10. An apparatus according to claim 1, wherein said second member extends upwardly at an angle with respect to said first member in said first position thereof, and extends substantially horizontally outwardly from an outer end of said second member in said second position thereof.

11. An apparatus according to claim 10, wherein said third and fourth surface portions are at substantially the same vertical level and said first and second surface portions are at different vertical levels, said second portion being vertically lower than said first portion.

12. An apparatus according to claim 1, wherein said patient support part includes means supporting thereon a bracket having an upwardly facing horizontal surface and a cylindrical pin projecting upwardly from said surface, and wherein said first member has a horizontally downwardly facing surface which is slidably engageable with said upwardly facing surface on said bracket and has means defining an opening extending thereinto from said downwardly facing surface for rotatably receiving said rod on said bracket to permit said first member to be pivoted about said pin relative to and be lifted upwardly out of engagement with said bracket.

13. An apparatus according to claim 12, including means for releasably securing said first member in each of a plurality of angular positions relative to said bracket, said means for releasably securing including a pin vertically movably supported on said bracket and having an upper end engageable with a plurality of angularly spaced openings provided in said downwardly facing surface of said first member.

14. An apparatus comprising: a patient support part having an upwardly facing patient support surface and having spaced foot support assemblies projecting approximately horizontally outwardly therefrom, a pad removably resting on and extending between said foot support assemblies, said apparatus being free of structure supporting said pad between said foot support assemblies, two straps secured to an underside of said pad and each extending downwardly between said foot support assemblies adjacent a respective one of said foot support assemblies, and fastening means for releasably securing each said strap to a respective one of said foot support assemblies.

15. An apparatus according to claim 14, wherein said fastening means includes cooperating hook and loop fastening structure on said straps and said foot support assemblies.

16. An apparatus comprising: a patient support part having an upwardly facing patient support surface and having spaced foot support assemblies projecting approximately horizontally outwardly therefrom, and a pad removably resting on and extending between said foot support assemblies, said apparatus being free of structure supporting said pad between said foot support assemblies, and means for maintaining each said foot support assembly in a position in which an end thereof remote from said patient support part is vertically higher than an end thereof adjacent said patient support part, so that said pad thereon is inclined to extend downwardly in a direction toward said support surface on said patient support part.

17. An apparatus comprising: a patient support part having an upwardly facing patient support surface, and a foot support assembly supported on said patient support part, said foot support assembly including a first member supported on said patient support part and extending in an approximately horizontal direction, said first member having spaced first and second surface portions on an upper side thereof and spaced third and fourth surface portions on an underside thereof, said foot support assembly further including a second member and support means supporting said second member on said first member for movement between first and second positions, said support means including spaced first and second portions on said second member which are respectively disposed above and below said first member, said first and second portions of said second member respectively engaging said first and third surface portions when said second member is in said first position and respectively engaging said second and fourth surface portions when said second member is in said second position, and including manually operable retaining means having first and second operational positions and cooperable with said second member for respectively preventing and permitting movement of said second member past said second position thereof in a direction away from said first position thereof.

18. An apparatus according to claim 17, wherein said second member includes a rod which extends transversely to said horizontal direction and has said second portion thereon, and wherein said retaining means includes a stop projecting downwardly from said underside of said first member and engageable with said rod to limit movement of said rod along said underside of said first member, and a retaining member supported on said first member near said stop for pivotal movement about a vertical axis between two positions which are said first and second operational positions and in which said retaining member respectively permits and prevents downward movement of said second rod when said second rod is adjacent said stop.

19. An apparatus comprising: a patient support part having an upwardly facing patient support surface and having spaced foot support assemblies projecting approximately horizontally outwardly therefrom, and a pad removably resting on and extending between said foot supply assemblies, said apparatus being free of structure supporting said pad between said foot support assemblies, and said pad having means defining a handle thereon, wherein said means defining said handle includes first and second spaced brackets fixedly supported on said pad, and a manually graspable handle part extending between and secured to said brackets.

20. An apparatus comprising: a patient support part having an upwardly facing patient support surface and having spaced foot support assemblies projecting approximately horizontally outwardly therefrom, and a pad removably resting on and extending between said foot support assemblies, said apparatus being free of structure supporting said pad between said foot support assemblies, and said pad having means defining a handle thereon, including at an outer end of each of said foot support assemblies an elongate and substantially horizontal handle part, and wherein said means defining said handle on said pad includes an elongate and substantially horizontal handle part which, when said pad is resting on said foot support assemblies, is substantially aligned with and has each end adjacent a respective one of said handle parts on said foot support assemblies.

21. An apparatus according to claim 20, wherein each of said handle parts is substantially cylindrical.

22. An apparatus comprising: a patient support part having an upwardly facing patient support surface, spaced foot support assemblies projecting approximately horizontally outwardly from said patient support part and each supported for horizontal movement relative to said patient support part and a pad removably resting on and extending between said foot support assemblies, said apparatus being free of structure supporting said pad between said foot support assemblies, and including bracket means cooperable with said pad and each of said foot support assemblies at locations spaced from said patient support part for releasably mechanically coupling said pad to each of said foot support assemblies.

23. An apparatus according to claim 22, wherein said bracket means includes two first bracket portions each provided on a respective one of said foot support assemblies, and two second bracket portions fixedly supported on said pad at spaced locations, each of said first bracket portions releasably engaging a respective one of said second bracket portions when said pad is resting on said foot support assemblies.

24. An apparatus according to claim 23, wherein said first bracket portions each having therein a recess, and said second bracket portions each include a bent metal strip, each said metal strip being received in a respective said recess when said pad is resting on said foot support assemblies.

25. An apparatus according to claim 23, wherein said pad has a handle part thereon, and wherein said bracket means includes means for permitting limited movement of said pad relative to said foot support assemblies in directions respectively toward and away from said patient support part respectively to first and second positions, and has means for respectively permitting and preventing upward movement of said second bracket portions relative to said first bracket portions when said pad is respectively in said first and second positions.

26. An apparatus according to claim 25, wherein said means for permitting and preventing upward movement of said second bracket portions includes each said second bracket portion having a clip portion, includes each said first bracket portion having in an upper side thereof a recess, and includes a downwardly facing retaining surface disposed over an end portion of said recess at an end of said recess remote from said patient support part, each said clip portion being disposed in a respective said recess when said pad is resting on said foot support assemblies.

27. An apparatus according to claim 26, wherein said bracket means includes first and second spaced brackets fixedly supported on said pad, said clip portions each being part of an respective said bracket on said pad, and including an elongate handle part extending between and secured to each of said brackets on said pad.

28. An apparatus according to claim 27, wherein said bracket means includes two brackets which are each supported on a respective one of said foot support assemblies near an outer end thereof and which each include a respective one of said first bracket portions having therein a respective one of said recesses, and including two further handle parts each mounted on a respective one of said brackets on said foot support assemblies.

29. An apparatus according to claim 28, wherein said brackets on said foot support assemblies are each approximately U-shaped and each have a bight and two spaced legs projecting outwardly from opposite ends of the bight, said bight of each said bracket being fixedly secured to an outer end of a respective one of said foot support assemblies, and each of said further handle parts extending between and having its ends secured to the respective legs of a respective one of said brackets on said foot support assemblies.

30. An apparatus according to claim 24, wherein each of said handle parts is approximately cylindrical, and wherein when said pad is supported on said foot support assemblies said handle part on said pad is substantially coaxial with and has each of its ends adjacent a respective one of said handle parts on said foot support assemblies.

31. An apparatus according to claim 30, wherein each said clip portion is an approximately S-shaped metal clip which has an upper end fixedly welded to a respective one of said brackets on said pad and which, from said upper end thereof, extends outwardly away from the bracket, then at a downward and inward incline toward the bracket, and then at a downward and outward incline away from the bracket.

32. An apparatus according to claim 30, wherein each said recess is defined by an approximately horizontal bottom surface extending approximately parallel to the direction of movement of said pad toward and away from patient support part, an approximately vertical end surface at each end of said recess, and a downwardly facing retainer surface extending toward said patient support part from an upper end of the vertical end surface remote from said patient support part.

33. An apparatus comprising: a patient support part having an upwardly facing patient support surface and having spaced foot support assemblies projecting approximately horizontally outwardly therefrom, and a pad removably resting on and extending between said foot support assemblies, said apparatus being free of structure supporting said pad between said foot support assemblies; wherein each said foot support assembly includes a foot support member which has thereon a foot support surface; and wherein an underside of said pad directly engages an upwardly facing surface portion on each said foot support member when said pad is removably resting on said foot support assemblies.

34. An apparatus according to claim 35, wherein said pad has means defining a handle thereon.

* * * * *

UNITED STATES PATENT AND TRADEMARK OFFICE

CERTIFICATE OF CORRECTION

PATENT NO. : 5 214 812

DATED : June 1, 1993

INVENTOR(S) : Richard J. BARTOW et al

It is certified that error appears in the above-identified patent and that said Letters Patent is hereby corrected as shown below:

Column 11, line 46; change "herein" to ---therein---.

Column 11, line 60; change "members" to ---portions--.

Column 14, line 45; change "having" to ---have---.

Column 15, lines 3-9, should read as follows:

--- 27~~29~~. (Amended) An apparatus according to Claim 26~~28~~, wherein said bracket means includes first and second spaced brackets which are fixedly supported on said pad[,] and which each include a respective one of said second bracket portions having thereon a respective said clip portion[s each being part of a respective said bracket on said pad], and including an elongate handle part extending between and secured to each of said brackets on said --- pad.

Signed and Sealed this

Fifteenth Day of February, 1994

*Attest:*

*Attesting Officer*

Bruce Lehman

BRUCE LEHMAN

*Commissioner of Patents and Trademarks*